US006437753B2

(12) United States Patent
Yuanzhu

(10) Patent No.: US 6,437,753 B2
(45) Date of Patent: Aug. 20, 2002

(54) PRIMARY RADIATOR SUITABLE FOR SIZE REDUCTION AND PREVENTING DETERIORATION OF CROSS POLARIZATION CHARACTERISTIC

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/773,723

(22) Filed: Jan. 31, 2001

(30) Foreign Application Priority Data

Feb. 3, 2000 (JP) ..... 2000-026742

(51) Int. Cl.[7] ..... H01Q 13/02
(52) U.S. Cl. ..... 343/772; 343/783
(58) Field of Search ..... 343/772, 785, 343/786, 776, 783, 781, 756; 333/240, 248

(56) References Cited

U.S. PATENT DOCUMENTS 4,468,672 A * 8/1984 Dragone ..... 343/783
5,359,339 A * 10/1994 Agrawal et al. ..... 343/786

FOREIGN PATENT DOCUMENTS

JP Hei 10-163737 6/1998

* cited by examiner

*Primary Examiner*—Don Wong
*Assistant Examiner*—James Clinger
(74) *Attorney, Agent, or Firm*—Brinks Hofer Gilson & Lione

(57) ABSTRACT

A dielectric feeder has a holding portion inserted into the interior of a waveguide and a horn-shaped radiating portion having different radiation angles in major- and minor-axis directions. A plurality of annular grooves each having a depth corresponding to about a quarter wavelength of a radio wavelength $\lambda_0$ is formed in an end face of the radiating portion. An outer peripheral surface of the holding portion is cut out at circumferentially opposed positions axially in parallel with each other to form a pair of flat surfaces. Both flat surfaces are positioned in the major axis directions of the radiating portion and are thereby allowed to function as a phase compensating portion for compensating a propagative phase difference induced in the radiating portion. Further, there is formed a stepped hole comprising two recesses which are contiguous to each other from an end face of the holding portion toward the interior of the holding portion. The recesses are each set at a depth corresponding to about a quarter wavelength of a radio wavelength $\lambda\in$ and are thereby allowed to function as an impedance converting portion.

13 Claims, 4 Drawing Sheets

PRIMARY RADIATOR SUITABLE FOR SIZE REDUCTION AND PREVENTING DETERIORATION OF CROSS POLARIZATION CHARACTERISTIC

BACKGROUND OF THE INVENTION

1. Field of the Invention

The present invention relates to a primary radiator provided, for example, in a reflector type antenna for satellite broadcast reception. Particularly, the invention is concerned with a primary radiator suitable for a reflector having a reflective surface which is not circular.

2. Description of the Prior Art

In the case where a primary radiator is disposed at a focal position of a reflector in a satellite broadcast receiving reflector type antenna, it is necessary, for efficiently receiving a radio wave from a satellite, that the shape of a reflective surface of the reflector and a radiation pattern of the primary radiator be matched. Usually, for this reason, in the case where the reflective surface of the reflector is in a non-circular shape such as an elliptic or rectangular shape, there is used a primary radiator wherein an aperture of a horn portion as a radio wave inlet is elliptic in shape.

FIG. 9 is a perspective view showing a conventional primary radiator of this type and FIG. 10 is a side view of the primary radiator as seen in an aperture direction of a horn portion. This primary radiator is provided with a horn portion 1 having an elliptic aperture 1*a*, a waveguide 2 of a circular section contiguous to the horn portion 1, and a dielectric plate 3 and a probe 4 both disposed in the interior of the waveguide 2. The horn portion 1 and the waveguide 2 are integrally formed, for example, by aluminum die casting or zinc die casting. The dielectric plate 3 has predetermined dielectric constant and shape and functions as a phase compensating portion which offsets a propagative phase difference based on a difference between a minor axis and a major axis in the aperture 1*a* of the horn portion 1. The probe 4 picks up a polarized wave which has been phase-compensated by the dielectric plate 3 and it is spaced a distance corresponding to about one fourth of the wavelength in waveguide from an end face 2*a* of the waveguide 2.

The primary radiator thus constructed is disposed at a focal position of a reflector having a reflective surface of a non-circular shape in a satellite broadcast receiving reflector type antenna. But a linearly polarized wave transmitted from a satellite has a predetermined polarization angle due to a positional relation to the place where the antenna is installed. For example, in case of receiving al linearly polarized wave from an ASTRA satellite in the suburbs of London, England, the linearly polarized wave has a polarization angle of about 13°. In this connection, since a reflector having an elliptic or rectangular reflective surface is installed horizontally with respect to the surface of the earth so as not to spoil the appearance thereof, a linearly polarized wave reflected by the reflector becomes incident in an inclined state with respect to the minor axis and major axis of the aperture 1*a* in the horn portion 1. When the polarization plane (an incident field polarization plane 5) of the incident radio wave is thus inclined relative to the minor axis and major axis of the elliptic aperture 1*a*, as shown in FIG. 10, the radio wave which has passed through the horn portion 1 becomes an elliptically polarized wave having a phase difference induced by an incident field minor axis component 6 and an incident field major axis component 7, which elliptically polarized wave is introduced into the waveguide 2. Also in the interior of the waveguide 2 there is induced a phase difference by both a component parallel to the dielectric plate 3 and a component perpendicular thereto. However, since this phase difference induced under the influence of the dielectric plate 3 and the foregoing propagative phase difference based on the minor-major axis difference in the aperture 1*a* of the horn 1 are set at a mutually offset relation, the elliptically polarized wave which has entered the interior of the waveguide 2 becomes a linearly polarized wave when passing through the dielectric plate 3 and is propagated to the innermost part of the waveguide. Then, for example a vertically polarized wave contained in the linearly polarized wave is received by the probe 4 and the received signal is frequency-converted into an IF frequency signal in a converter circuit (not shown), which IF frequency signal is outputted.

In the conventional primary radiator constructed as above, since the horn portion having the elliptic aperture 1*a* is formed in one piece with the waveguide 2 by, for example, aluminum die casting or zinc die casting, the manufacturing cost, including the cost of the mold used, becomes high and the size of the primary radiator becomes large. Moreover, although the propagative phase difference induced in the horn portion 1 is offset by the dielectric plate 3 mounted in the interior of the waveguide 2, if the dielectric plate 3 is not accurately mounted with respect to the minor and major axes of the horn portion 1, the dielectric plate 3 does not fulfill its function as a phase compensator to a satisfactory extent and there occurs a marked deterioration of the cross polarization characteristic.

SUMMARY OF THE INVENTION

The present invention has been accomplished in view of such actual circumstances of the prior art and it is an object of the invention to provide a primary radiator which is less expensive and suitable for the reduction of size and which can positively prevent the deterioration of a cross polarization characteristic.

For achieving the above-mentioned object, the primary radiator of the present invention comprises a waveguide having a radio wave introducing aperture at one end thereof and a dielectric feeder held in an aperture end of the waveguide, the dielectric feeder being provided with a radiating portion having different radiation angles in two-axis directions orthogonal to each other, a phase compensating portion for compensating a propagative phase difference in two-axis directions induced in the radiating portion, and a converting portion for impedance-matching a radio wave between it and the waveguide.

With use of such a dielectric feeder, it is not only possible to shorten the overall length of the primary radiator, including the radiating portion, but also possible to simplify the shape of the waveguide and thereby reduce the manufacturing cost. Besides, since the radiating portion and the phase compensating portion are integrally provided in the dielectric feeder, the propagative phase difference induced in the radiating portion is sure to be offset in the phase compensating portion and it is possible to positively prevent the deterioration of a cross polarization characteristic.

In the above construction it is preferable that the radiating portion be formed in a wedge or horn shape. Particularly, if a plurality of annular grooves having a depth corresponding to a quarter wavelength of a radio wave are formed in an end face of the horn-shaped radiating portion, the radio waves reflected by both end face of the radiating portion and bottoms of the annular grooves are phase-cancelled and therefore can be converged efficiently to the radiating portion.

As the phase compensating portion in the above construction there may be adopted any of various forms. For example, there may be adopted a construction in which an outer peripheral surface of the dielectric feeder is cut out to form a pair of flat surfaces so that the flat surfaces are opposed to each other in parallel in the major axis direction of the radiating portion, thereby constituting a phase compensating portion.

Alternatively, there may be adopted a construction wherein a cavity is formed in the interior of the dielectric feeder so as to be in a long and slender shape in the major axis direction of the radiating portion, to constitute a phase compensating portion. In this connection, if the foregoing converting portion is constituted by a stepped hole comprising a plurality of axially contiguous recesses, the recesses each having a quarter wavelength of a radio wave, it is preferable that at least one of the recesses also function as a phase compensating portion.

Alternatively, there may be adopted a construction wherein a projecting portion is formed at an end face of the dielectric feeder on the side opposite to the radiating portion so as to be in a long and slender shape in the minor axis direction of the radiating portion, thereby constituting a phase compensating portion. In this connection, if the converting portion is constituted by a stepped projection comprising a plurality of axially contiguous projecting portions, the projecting portions each having a height corresponding to a quarter wavelength of a radio wave, it is preferable that at least one of the projecting portions also function as a phase compensating portion.

DETAILED DESCRIPTION OF THE PREFERRED EMBODIMENTS

Figure 1:
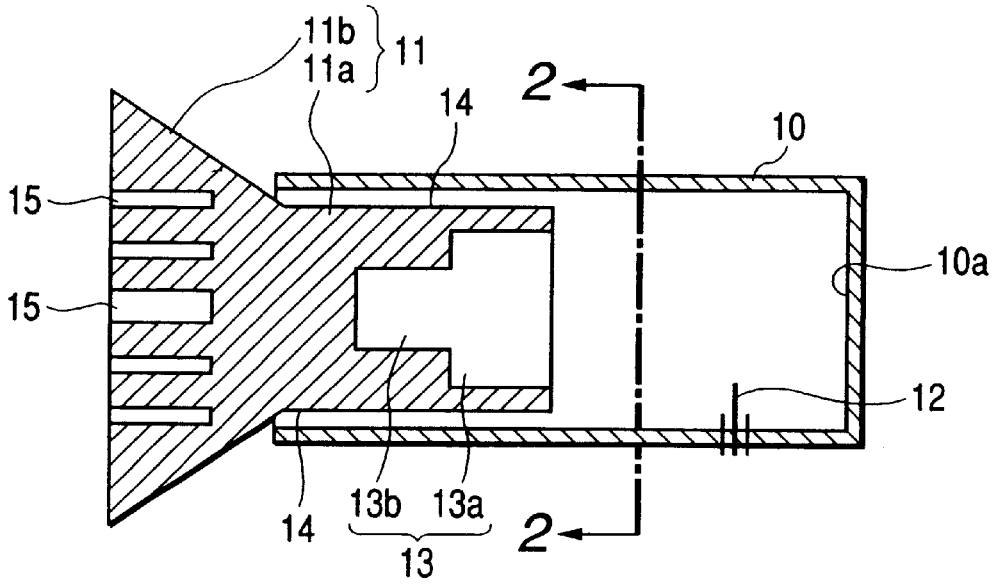
FIG. 1 is a configuration diagram of a primary radiator according to a first embodiment of the present invention.
Figure 2:
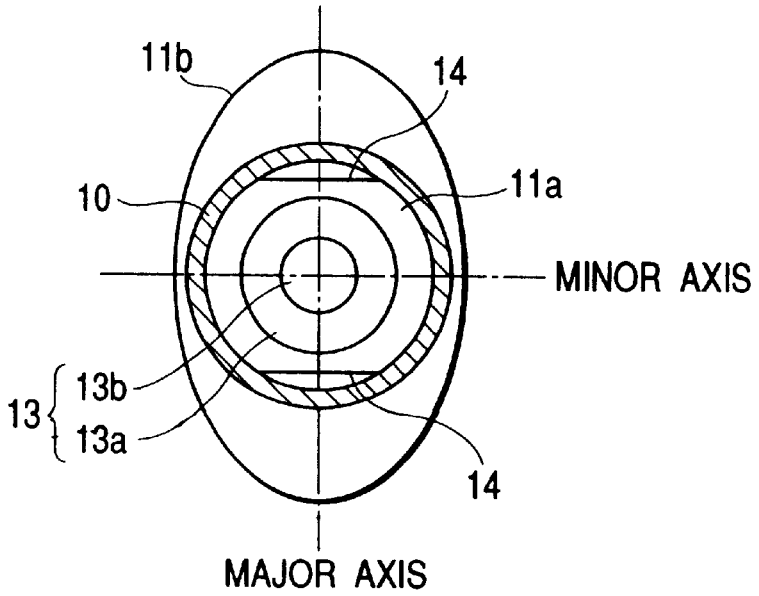
FIG. 2 is a sectional view taken along line 2—2 in FIG. 1.
Figure 3:
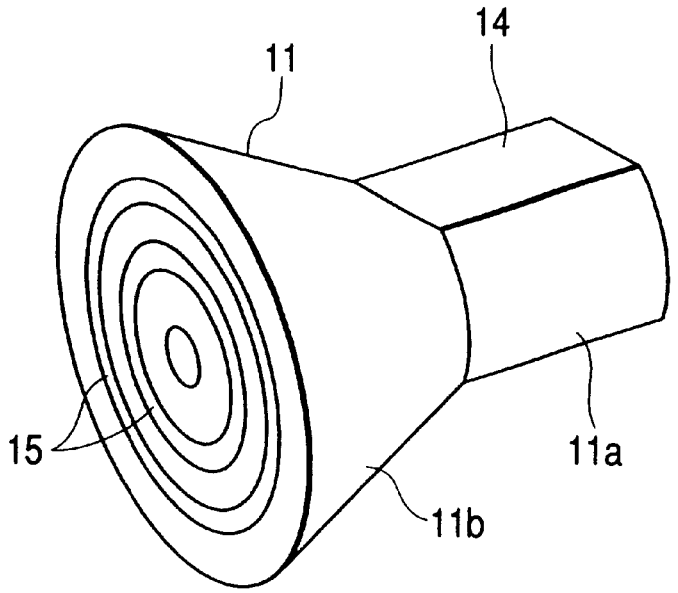
FIG. 3 is a perspective view of a dielectric feeder provided in the primary radiator.

Embodiments of the present invention will be described hereinunder with reference to the accompanying drawings, in which FIG. 1 is a configuration diagram of a primary radiator according to a first embodiment of the present invention, FIG. 2 is a sectional view taken along line 2—2 in FIG. 1, and FIG. 3 is a perspective view of a dielectric feeder provided in the primary radiator.

As shown in those figures, the primary radiator of this embodiment is provided with a waveguide 10 of a circular section which is open at one end thereof and is closed as a closed surface 10*a* at the opposite end, and a dielectric feeder 11 which is held at the open end of the waveguide 10. A probe 12 is mounted in the interior of the waveguide 10. The closed surface 10*a* of the waveguide 10 and the probe.12 are spaced apart a distance corresponding to about a quarter wavelength of a wavelength in waveguide λg, and the probe 12 is connected to a converter circuit (not shown).

The dielectric feeder 11 is formed using a dielectric material of a low dielectric loss tangent. In this embodiment, as such a material there is used a polyethylene (dielectric constant ∈=2.25) taking the inexpensiveness thereof into account. The dielectric feeder 11 is composed of a holding portion 11*a* inserted into the waveguide 10 and a radiating portion 11*b* which expands in a horn shape toward the exterior from the open end of the waveguide 10. The holding portion 11*a* is formed with a stepped hole 13 which functions as an impedance converting portion and is also formed with a pair of flat surfaces 14 which function as a phase compensating portion. The stepped hole 13 comprises two recesses 13*a* and 13*b* which are different in diameter and which are contiguous to each other from an end face of the holding portion 11*a* toward the interior. The recesses 13*a* and 13*b* are each set at a depth (axial length) corresponding to about a quarter wavelength of a radio wavelength λ∈ propagated through the dielectric feeder 11. The flat surfaces 14 are formed by cutting out an outer peripheral surface of the holding portion 11*a* in the axial direction at positions opposed to each other in parallel at an angle of 180°. The outside diameter of the holding portion 11*a* exclusive of the flat surfaces 14 is set at a value almost equal to the inner diameter of the waveguide 10. By press-fitting the holding portion 11*a* into the open end of the waveguide 10 along the inner surface of the open end, the dielectric feeder 11 is fixed to the waveguide 10. The radiating portion 11*b* is an elliptic radiation portion having different radiation angles in major- and minor-axis directions orthogonal to each other, and both flat surfaces 14 are positioned in the major axis direction of the radiating portion 11*b*. A plurality of annular grooves 15 are formed in. an end face of the radiating portion 11*b* and the depth (axial length) of each annular groove 15 is set at a value corresponding to about a quarter wavelength of a radio wavelength λo propagated in air.

In the primary radiator thus constructed, a linearly polarized wave which has been reflected by an elliptic or rectangular reflector of a satellite broadcast receiving reflector type antenna enters the end face of the radiating portion 11*b* and is converged to the dielectric feeder 11. In this case, since plural annular grooves 15 are formed in the end face of the radiating portion 11*b* and the depth of each annular groove 15 is set at a value corresponding to about a quarter wavelength of the radio wavelength So propagated in air, the radio waves reflected by the end face of the radiating portion 11*b* and the bottoms of the annular grooves 15 are phase-cancelled. As a result, there scarcely is any reflective component in the radio waves traveling toward the radiating portion 11*b*, thus permitting the radio waves to be converged to the dielectric feeder 11 efficiently.

Where the polarization plane of the radio wave incident on the radiating portion 11*b* is inclined relative to the minor and major axes, the radio wave which has passed through the radiating portion 11*b* becomes an elliptically polarized wave having a phase difference between minor- and major-axis components. The elliptically polarized wave advances toward the holding portion 11*a* and upon passing the holding portion 11*a* it is linearly polarized by both flat surfaces 14 as a phase compensating portion. More specifically, since the flat surfaces 14 are formed by partially cutting off the dielectric material of the holding portion 11*a* on both end sides in the major axis direction of the radiating portion 11*b*, the holding portion 11*a* becomes a-flat shape which is long in the minor axis direction of the radiating portion 11*b*, whereby the phase difference induced in the radiating portion 11*b* and that induced in the holding portion 11*a* are offset each other. Consequently, the radio wave incident on the radiating portion 11*b* becomes a linearly polarized wave upon passing through the holding portion 11*a* and is impedance-matched with the waveguide 10 at the end face of the holding portion 11*a*. At this time, since the stepped hole 13 comprising the two recesses 13*a* and 13*b* contiguous to each other is formed in the end face of the holding portion 11*a* and the recesses 13*a* and 13*b* are each set at a depth corresponding to about a quarter wavelength of the radio wavelength λ∈ propagated through the dielectric feeder 11, the radio wave reflected by the end face of the holding portion 11*a* and the bottom of the recess 13*b* which is small in diameter and the radio wave reflected by the bottom of the recess 13*a* which is large in diameter are phase-reversed and cancelled, so that there scarcely any reflective component in the radio wave propagated through the dielectric feeder 11 and advancing into the waveguide 10 and hence the dielectric feeder 11 and the waveguide 10 are impedance-matched to a satisfactory extent. Then, for example a vertically polarized wave contained in the linearly polarized wave which has entered the waveguide 10 is received by the probe 4 and the thus-received signal is frequency-converted to an IF frequency signal in a converter circuit (not shown), which IF frequency signal is then outputted.

In the first embodiment described above, since the dielectric feeder 11 is integrally formed with the radiating portion 11*b* as an elliptic radiating portion and the flat surfaces 14 as a phase compensating portion, the propagative phase difference induced in the radiating portion 11*b* can surely be offset in the phase compensating portion (flat surfaces 14), whereby it is possible to prevent the cross polarization characteristic from being deteriorated by a mounting error of the dielectric feeder 11. Besides, since the dielectric feeder is composed of the holding portion 11*a* and the radiating portion 11*b*, which can each be shortened in length, this construction is suitable for the reduction in size of the primary radiator. Further, the shape of the waveguide 10 becomes simple and it becomes possible to form the waveguide by sheet metal working as necessary, thus making it possible to reduce the manufacturing cost.

Figure 4:
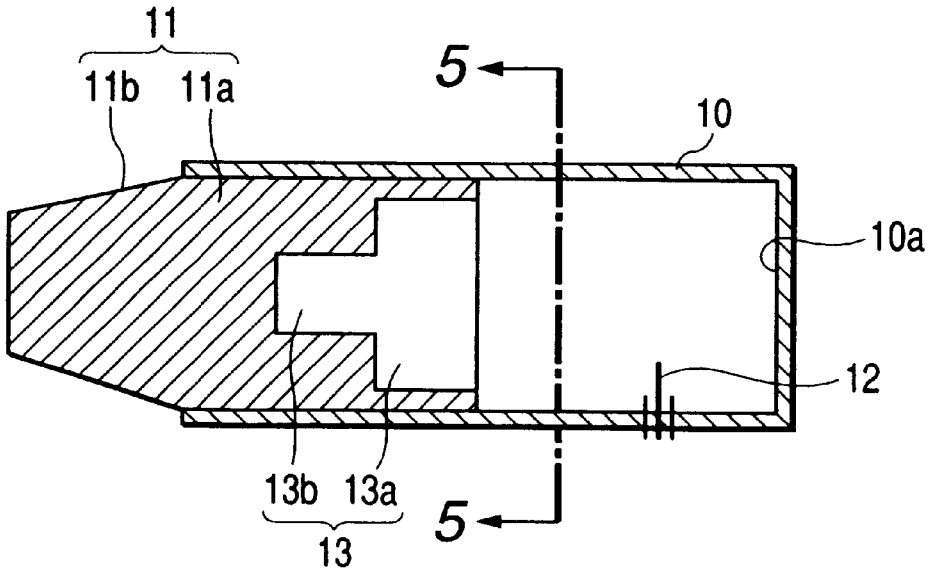
FIG. 4 is a configuration diagram of a primary radiator according to a second embodiment of the present invention.
Figure 5:
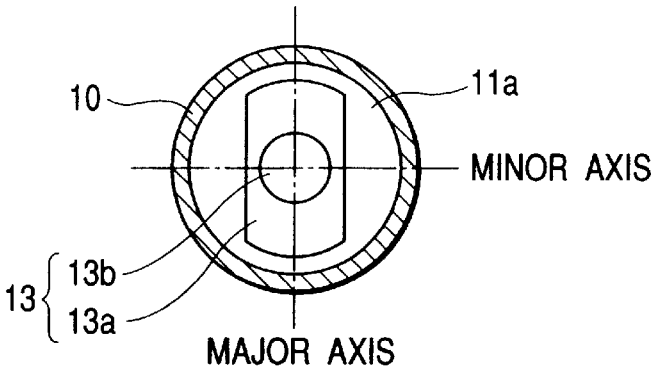
FIG. 5 is a sectional view taken along line 5—5 in FIG. 4.
Figure 6:
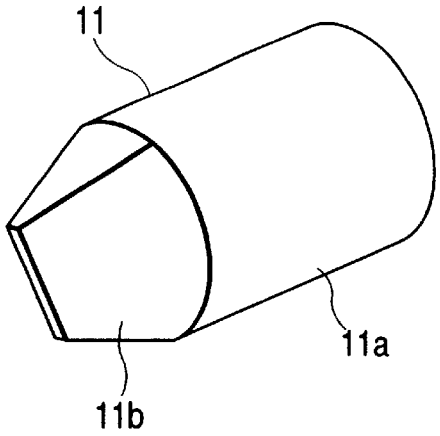
FIG. 6 is a perspective view of a dielectric feeder provided in the primary radiator shown in FIG. 4.

FIG. 4 is a configuration diagram of a primary radiator according to a second embodiment of the present invention, FIG. 5 is a sectional view taken along line 5—5 in FIG. 4, and FIG. 6 is a perspective view of a dielectric feeder provided in the primary radiator. In these figures, the portions corresponding to FIGS. 1 to 3 are identified by the same reference numerals as in FIGS. 1 to 3.

In the primary radiator of this second embodiment, the radiating portion 11*b* of the dielectric feeder 11 is formed in a wedge shape, not a horn shape, but this wedge-shaped radiating portion 11*b* is also an elliptic radiating portion having different radiation angles in major- and minor-axis directions orthogonal to each other. Further, in connection with the stepped hole 13 which functions as an impedance converting portion, if the recess 13 of a large diameter is formed in a long and slender shape in the major axis direction of the radiating portion 11*b* and the stepped hole 13 is given both functions as an impedance converting portion and a phase compensating portion. To be more specific, if the long and slender recess 13*a* is formed in the interior of the holding portion 11*a* having a cylindrical outer peripheral surface, the proportion of the dielectric material of the holding portion 11*a* decreases in the major axis direction of the recess 13*a*, so that the recess 13*a* functions as a phase compensating portion like the flat surfaces 14 in the first embodiment, whereby the phase difference induced in the radiating portion 11*b* and that induced in the holding portion 11*a* can be offset each other.

The present invention is not limited to the above embodiments, but various modifications may be adopted. For example, the radiating portion, the phase compensating portion and the impedance converting portion shown in each of the above embodiments may be suitably combined, or the number of steps of the stepped hole may be increased, or the sectional shape of the holding portion in the dielectric feeder or of the waveguide may be made square instead of a circular shape.

Figure 7:
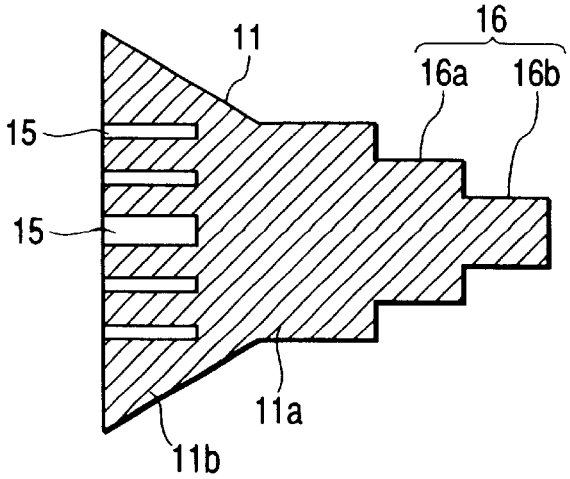
FIG. 7 is a configuration diagram of a dielectric feeder, showing a modification.
Figure 8:
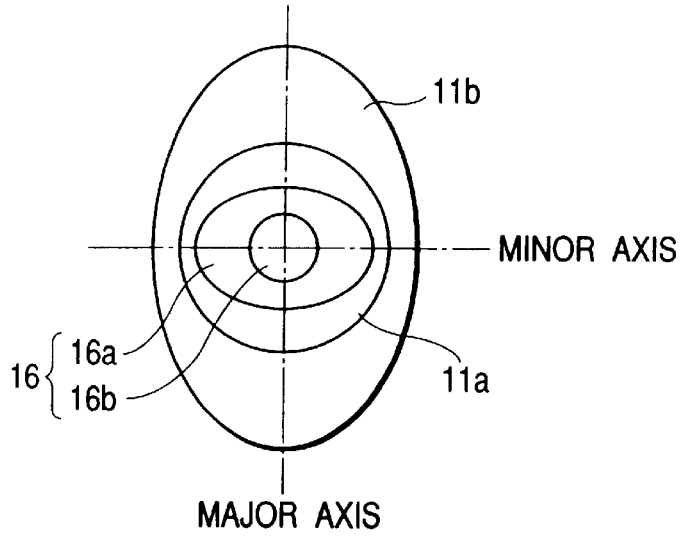
FIG. 8 is a side view of the dielectric feeder of FIG. 7 as seen in an end face direction of a holding portion.
Figure 9:
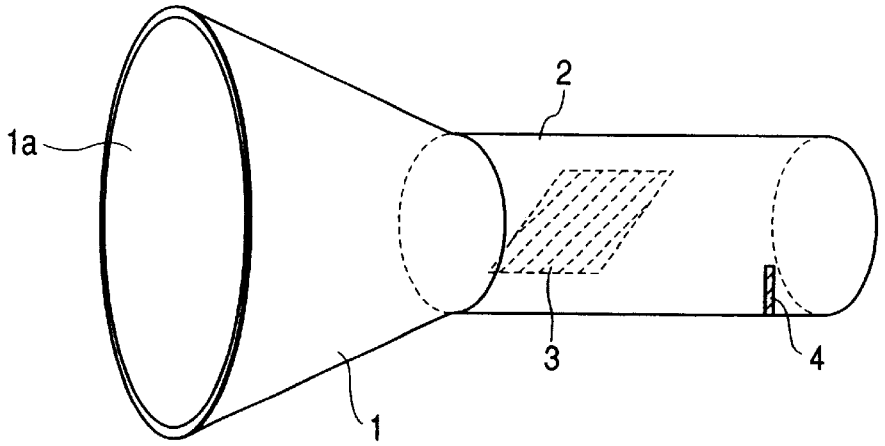
FIG. 9 PRIOR ART
FIG. 9 is a perspective view of a conventional primary radiator.
Figure 10:
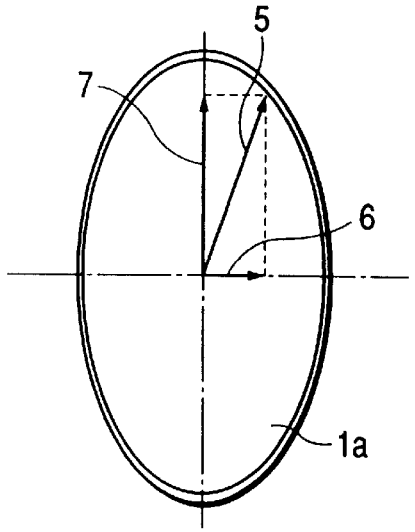
FIG. 10 PRIOR ART
FIG. 10 is a side view of the conventional primary radiator as seen in an aperture direction of a horn portion.

Alternatively, as shown in FIGS. 7 and 8, a stepped projection 16 may be formed on the end face of the projecting portion 11*a* so as to possess both the function as a phase compensating portion and the function of the impedance converting portion. The stepped projection 16 comprises two projecting portions 16*a* and 16*b* which have each a height corresponding to about a quarter wavelength of the radio wavelength λ∈ and which are contiguous each other in the axial direction. Like the stepped hole 13 in each of the above embodiments, the stepped projection 16 functions as an impedance converting portion, and one projecting portion 16*a* functions also as a phase compensating portion. Also in this case it goes without saying that the radiating portion 11*b* may be formed in a wedge shape or the number of steps of the stepped projection 16 may be increased.

The present invention is carried out in such modes as embodied above and brings about the following effects.

In the primary radiator applied to a reflector having a reflector surface of a non-circular shape such as an elliptic or rectangular shape, the dielectric feeder is integrally formed with a radiating portion, a phase compensating portion and an impedance converting portion, so by allowing the dielectric feeder to be held in a waveguide, not only it is possible to shorten the overall length of the primary radiator, including the radiating portion, but also it is possible to simplify the shape of the waveguide and reduce the manufacturing cost. Moreover, since the dielectric feeder is integrally formed with the radiating portion and the phase compensating portion, a propagative phase difference induced in the radiating portion is sure to be offset in the phase compensating portion, whereby it is possible to surely prevent the deterioration of a cross polarization characteristic.

What is claimed is:

1. A primary radiator comprising:

a waveguide having a radio wave introducing aperture at one end thereof; and a dielectric feeder formed of a dielectric material held in an aperture end of the waveguide, wherein the dielectric feeder is provided with a converting portion for impedance-converting the radio wave from a mode of the waveguide to a mode of the dielectric material, a radiating portion showing a radiation pattern having a major axis and a minor axis in two directions with radiation angles orthogonal to each other where the radio wave in the mode of the dielectric material is radiated in the air, and a phase compensating portion for compensating a propagative phase difference produced between the major axis and the minor axis when the radio wave in the mode of the dielectric material is transmitted from the converting portion to the radiating portion.

2. A primary radiator according to claim 1, wherein the radiating portion is formed in a horn shape, and an end face of the radiating portion has an elliptical shape and is provided with a plurality of annular grooves each having a depth corresponding to a quarter wavelength of the radio wave.

3. A primary radiator according to claim 1, wherein the radiating portion is formed in a wedge shape.

4. A primary radiator according to claim 2, wherein the phase compensating portion comprises a pair of flat surfaces formed by cutting out an outer peripheral surface of the dielectric feeder, the flat surfaces being opposed to each other in parallel in a major axis direction of the radiating portion.

5. A primary radiator according to claim 3, wherein the phase compensating portion comprises a pair of flat surfaces formed by cutting out an outer peripheral surface of the dielectric feeder, the flat surfaces being opposed to each other in parallel in a major axis direction of the radiating portion.

6. A primary radiator according to claim 2, wherein the phase compensating portion is constituted by a cavity formed in the interior of the dielectric feeder, the cavity being formed in a long and slender shape in a major axis direction of the radiating portion.

7. A primary radiator according to claim 3, wherein the phase compensating portion is constituted by a cavity formed in the interior of the dielectric feeder, the cavity being formed in a long and slender shape in a major axis direction of the radiating portion.

8. A primary radiator according to claim 6, wherein the converting portion is constituted by a stepped hole comprising a plurality of recesses, the recesses being contiguous to each other axially and each having a depth corresponding to a quarter wavelength of the radio wave, at least one of the recesses serving also as the cavity.

9. A primary radiator according to claim 7, wherein the converting portion is constituted by a stepped hole comprising a plurality of recesses, the recesses being contiguous to each other axially and each having a depth corresponding to a quarter wavelength of the radio wave, at least one of the recesses serving also as the cavity.

10. A primary radiator according to claim 2, wherein the phase compensating portion is constituted by a projecting portion formed at an end face of the dielectric feeder on the side opposite to the radiating portion side, the projecting portion being formed in a long and slender shape in a minor axis direction of the radiating portion.

11. A primary radiator according to claim 3, wherein the phase compensating portion is constituted by a projecting portion formed at an end face of the dielectric feeder on the side opposite to the radiating portion side, the projecting portion being formed in a long and slender shape in a minor axis direction of the radiating portion.

12. A primary radiator according to claim 10, wherein the converting portion is constituted by a stepped projection comprising a plurality of projecting portions, the projecting portions being contiguous to one another axially and each having a height corresponding to a quarter wavelength of the radio wave, at least one of the projecting portions serving also as the projecting portion formed at the opposite-side end face.

13. A primary radiator according to claim 11, wherein the converting portion is constituted by a stepped projection comprising a plurality of projecting portions, the projecting portions being contiguous to one another axially and each having a height corresponding to a quarter wavelength of the radio wave, and at least one of the projecting portions serving also as the projecting portion formed at the opposite-side end face.

* * * * *